US006459875B1

(12) United States Patent
Saitoh

(10) Patent No.: US 6,459,875 B1
(45) **Date of Patent: *Oct. 1, 2002**

(54) IMAGE DRYING DEVICE FOR WET TYPE IMAGE FORMING APPARATUS

(75) Inventor: Junichi Saitoh, Yamagata (JP)

(73) Assignee: NEC Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/695,305

(22) Filed: Oct. 25, 2000

(30) Foreign Application Priority Data

Oct. 28, 1999 (JP) ..... 11-307174

(51) Int. Cl.[7] ..... G03G 15/11
(52) U.S. Cl. ..... 399/251
(58) Field of Search ..... 399/249, 251, 399/352

(56) References Cited

U.S. PATENT DOCUMENTS 5,640,655 A * 6/1997 Shoji ..... 399/249
5,841,456 A * 11/1998 Takei et al. ..... 399/249 X
6,064,851 A * 5/2000 Saitoh ..... 399/249 X
6,219,512 B1 * 4/2001 Saitoh ..... 399/249

FOREIGN PATENT DOCUMENTS

| | | |
|---|---|---|
| JP | 58-97076 | 6/1983 |
| JP | 3-163451 | 7/1991 |
| JP | 11-184344 | 7/1999 |
| JP | 11-231743 | 8/1999 |

* cited by examiner

*Primary Examiner*—Fred L. Braun
(74) *Attorney, Agent, or Firm*—Sughrue Mion, PLLC

(57) ABSTRACT

A novel drying device for a wet type image forming apparatus including a nip roller; a heating roller incorporating a heater therein; a drying belt wound between the nip roller and the heating roller for circulation, being heated by said heating roller and being urged to contact with a surface of a photoconductor after forming a toner image for absorbing a developing solvent other than toner from the surface of the photoconductor; and a cleaning roller incorporating a heater and rotating with contacting with the drying belt. A drying unit including the nip roller, heating roller, and drying belt is moved so that the drying belt is displaced between a contacting position where it contacts with the surface of the photoconductor when in a printing state and a retracted position placed way from the conductor otherwise.

22 Claims, 3 Drawing Sheets

IMAGE DRYING DEVICE FOR WET TYPE IMAGE FORMING APPARATUS

BACKGROUND OF THE INVENTION

1. Field of the Invention

The present invention relates to an image drying device for physically drying a toner image formed on a surface of a photoconductor in a wet type image forming apparatus for a wet electrophotographic type multi-color printer, copy machine or the like which performs liquid development.

2. Description of the Related Art

In a copy machine, a printer or the like of wet electrophotographic recording system which performs liquid development, a liquid carrier for charging toner is contained in a developing fluid as a primary component in order to selectively develop toner particles dispersed in the developing fluid. Therefore, it is required a process for absorbing only liquid component and drying solid component up to about 95 to 97% for forming a film in order to sufficiently dry the image and forming a film of a multi-color image in an order of several to several tens microns before transferring the toner image onto a printing paper using a pressure and a heat.

One of technologies for performing the process has been disclosed in Japanese Unexamined Patent Publication No. Heisei 11-231743. Disclosed in the above-identified Japanese Unexamined Patent Publication No. Heisei 11-231743 has a construction, in which a squeezing roller and a pack-up roller are arranged in opposition to each other at a location downstream of a developing roller performing liquid development with respect to a belt photoconductor for clamping the belt photoconductor developed by the developing roller by the squeezing roller and the back-up roller for removing the ink deposited on the portion other than latent image of the belt photoconductor by the squeezing roller, in conjunction therewith drying the developed image by the squeezing roller for forming the film, and cleaning the squeezing roller by means of a blade.

However, the method of drying (forming a film) by means of the squeezing roller encounters a difficulty in providing sufficiently large peripheral length in the squeezing roller and in obtaining sufficient area for absorbing, dispersing and evaporating a developing solvent or the like other than toner. Therefore, in the squeezing roller, it is repeated operation to again contact with the belt conductor before drying of the surface per se or evaporation of the developing solvent to make adhesive force of the surface of the squeezing roller excessively and non-uniformly high due to impurity contained in the developing solvent having viscosity to peel off (picking) the toner image on the belt photoconductor by the squeezing roller which is originally designed for removing the developing solvent or the like other than the toner. As a result, temporary image degradation, such as white out and so forth can be caused on the printing medium. Furthermore, the toner particle peeled off the surface of the developing roller may deposit on the surface of the squeezing roller to lower absorption perform in the portion where the toner is deposited. As a result, the toner image on the photoconductor becomes too wet to be a cause of color shade or the like due to failure in transfer when large number of copies are printed. Therefore, difficulty is encountered in constantly maintain a predetermined image quality. Also, if the peripheral length of the squeezing roller is short, degradation of function becomes quick to shorten the life.

SUMMARY OF THE INVENTION

It is an object of the present invention to provide an image drying device which can provide sufficient area for absorbing, dispersing and evaporating a developing solvent or the like other than toner, improve efficiency of drying by absorbing the developing solvent or the like other than toner from the surface of the photoconductor after formation of the toner image, eliminate occurrence of peeling off (picking) of the toner image to peel off the toner image from the photoconductor and thus maintain a predetermined image quality for a long period.

In order to accomplish the above-mentioned object, the present invention employs a belt in place of the conventional squeezing roller to circulate the belt with contacting with a surface of a photoconductor after formation of a toner image to absorb the developing solvent or the like other than toner from the surface of the photoconductor, and to heat the belt for promoting evaporation.

According to the first aspect of the present invention, an image drying device of a wet type image forming apparatus comprising:

a drying belt circulating in a conduction contacting with a surface of a photoconductor after formation of a toner image and absorbing a developing solvent or the like other than toner from the surface of the photoconductor; and a cleaning roller incorporating a heater and rotating with contacting with the drying belt.

According to the second aspect of the present invention, an image drying device for a wet type image forming apparatus comprising:

a nip roller;

a heating roller incorporating a heater therein; and a drying belt wound between the nip roller and the heating roller for circulation, being heated by the heating roller and being urged to contact with a surface of a photoconductor after forming a toner image for absorbing a developing solvent or the like other than toner from the surface of the photoconductor.

According to the third aspect of the present invention, an image drying device for a wet type image forming apparatus comprising:

a nip roller;

a heating roller incorporating a heater therein;

a drying belt wound between the nip roller and the heating roller for circulation, being heated by the heating roller and being urged to contact with a surface of a photoconductor after forming a toner image for absorbing a developing solvent or the like other than toner from the surface of the photoconductor; and a cleaning roller incorporating a heater and rotating with contacting with the drying belt.

The first to third aspect of the present invention further comprises cleaning roller moving mechanism for moving the cleaning roller between a contacting position where the cleaning roller contact with the drying belt and a retracted position where the cleaning roller is placed away from the drying belt in order to maintain the performance of the drying belt for long period.

The cleaning roller moving mechanism may place the cleaning roller at the contacting position while the wet type image forming apparatus is in printing operation and at the retracted position otherwise.

The cleaning roller may be preliminarily heated to a predetermined temperature by means of a heater incorporated therein before being moved from the retracted position to the contacting position.

The cleaning roller may be heated by the heater incorporated therein at the retracted position for regeneration whenever number of printing of the wet type image forming apparatus reaches a preliminarily set number.

With the foregoing constructions, particularly in the second and third aspect of the invention of the image drying device, the nip roller, the heating roller and the drying belt may be combined as a drying unit, and the image drying device further comprises a drying unit moving mechanism for moving the drying unit so that the drying belt is displaced between a contacting position where it contacts with the surface of the photoconductor and a retracted position placed away from the surface of photoconductor.

In case of the third aspect of the invention, the cleaning roller moving mechanism is cooperated with the drying unit moving mechanism.

The drying unit moving mechanism may drive the drying unit to move to the contacting position to contact the drying belt with the surface of the photoconductor while the wet type image forming apparatus is in printing state, and to the retracted position otherwise.

The heating roller may be heated at a predetermined temperature by a heater incorporated therein before the drying unit is moved from the retracted position to the contacting position.

The drying unit may circulate the drying belt by own driving system independently of the photoconductor.

The drying belt is formed by forming an elastomer layer of a material absorbing a developing solvent or the like on a surface of a base material of polyethylene terephthalate resin.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure are not shown in detail in order to avoid unnecessary obscurity of the present invention.

Figure 1:
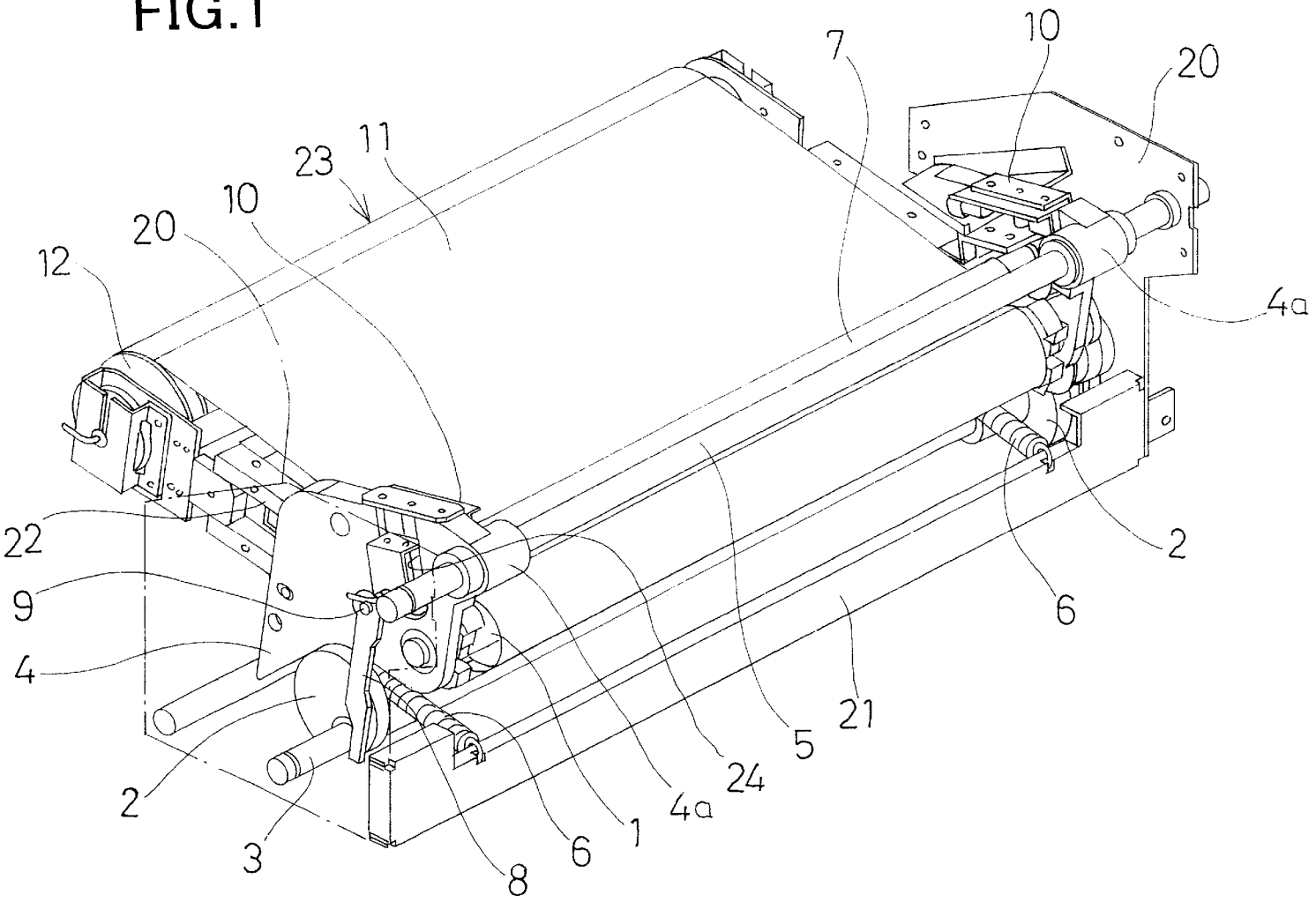
FIG. 1 is an external perspective view showing only image drying device according to the present invention to be installed in a wet type image forming apparatus.
Figure 2:
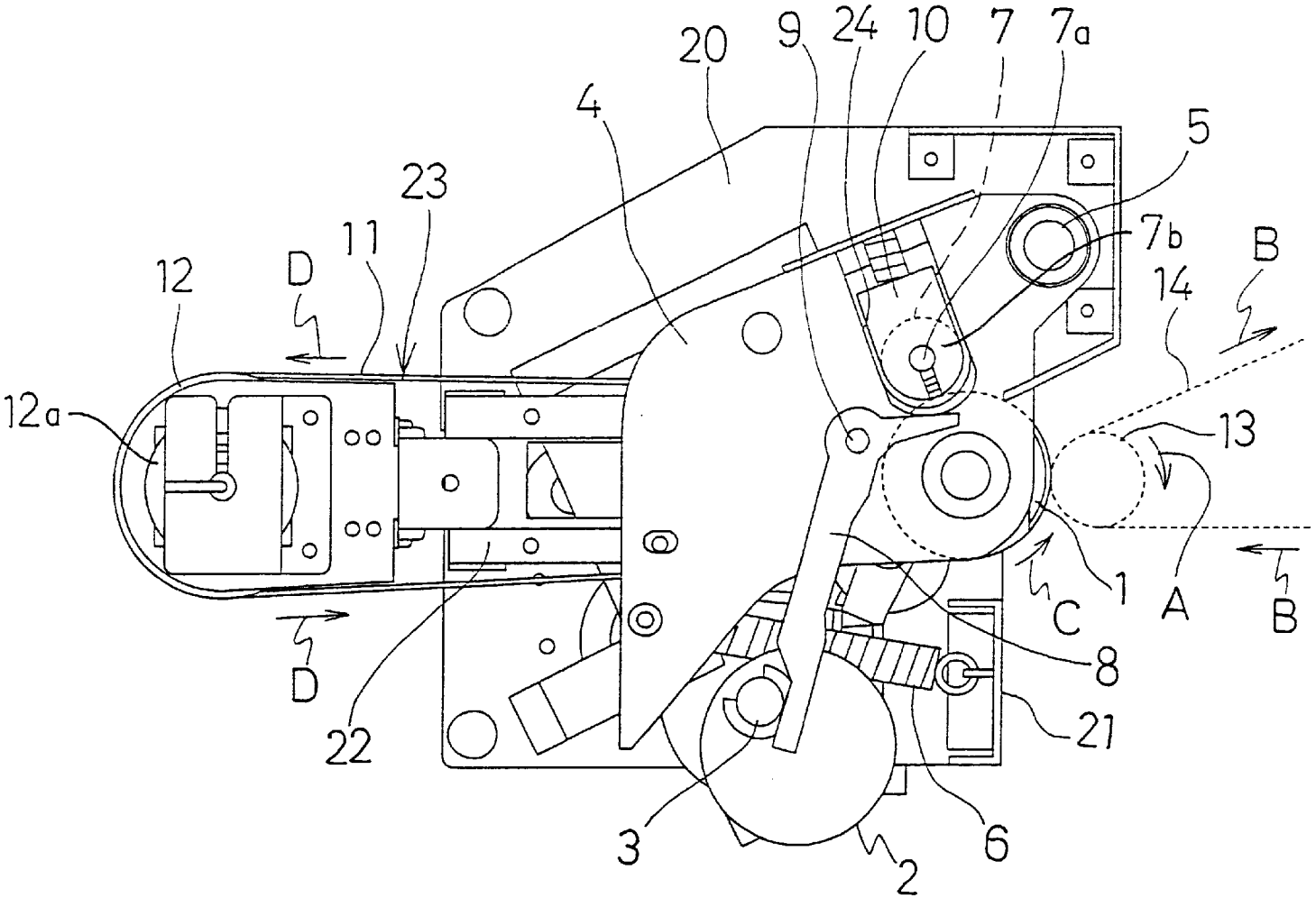
FIG. 2 is a side elevation of the image drying device at printing state of the wet type image forming apparatus.
Figure 3:
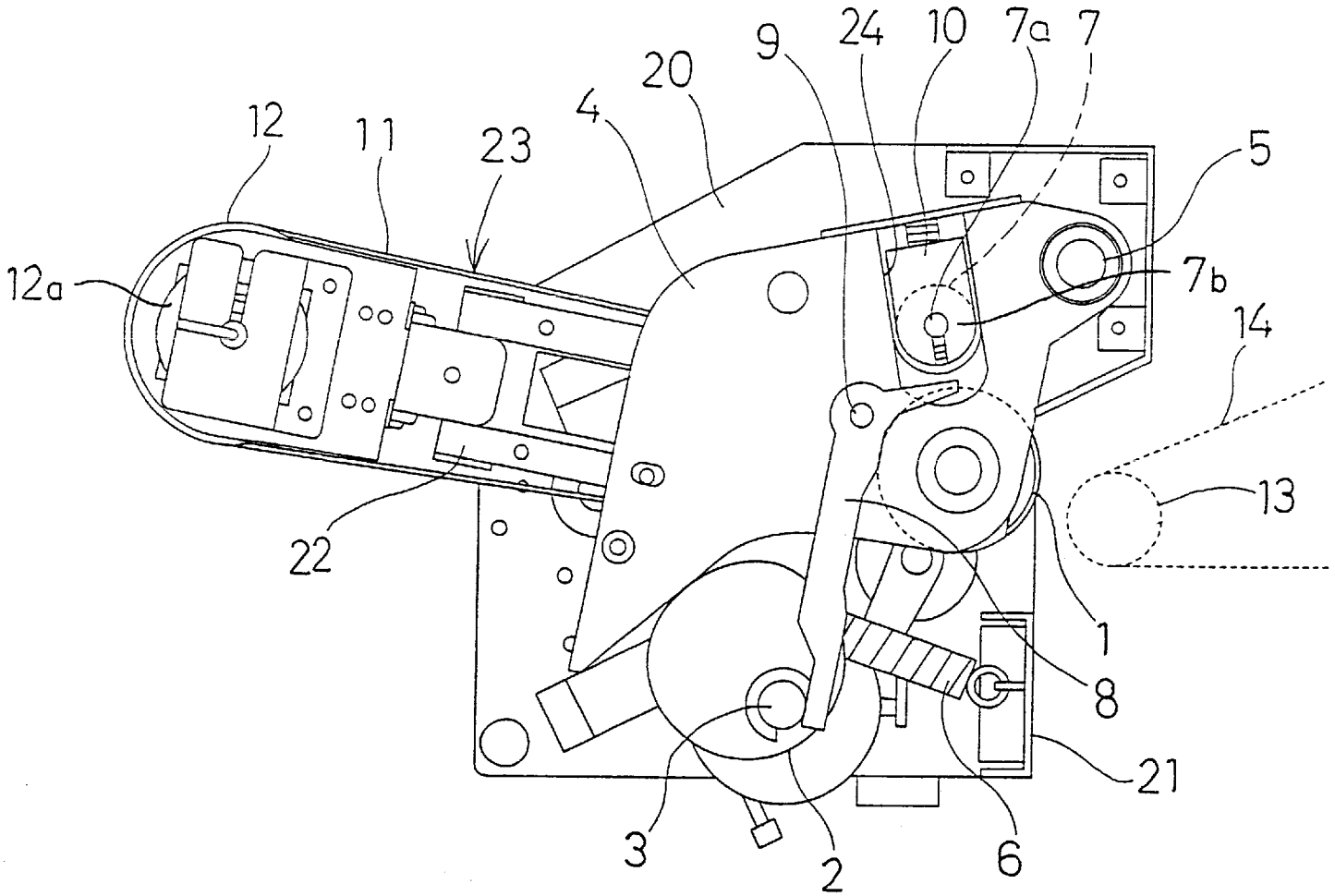
FIG. 3 is a side elevation of the image drying device while not printing.

FIG. 1 is an external perspective view showing only image drying device according to the present invention to be installed in a wet type image forming apparatus, FIG. 2 is a side elevation of the image drying device at printing state of the wet type image forming apparatus, and FIG. 3 is a side elevation of the image drying device while not printing.

In FIG. 1, the image drying device is installed on a frame constituted with both side plates 20 and a broom board 21 in the following manner.

On a pivot shaft 5 journaled between the side plates 20 on both sides a pair of swing plates 4 are fixed by bosses 4*a* to be simultaneously pivotable about the pivot shaft 5. Between a pair of swing plates 4, a nip roller 1 is rotatably journaled. A heat roller 12 incorporating a heater, such as a halogen lamp or the like is rotatably supported via joint arms 22. Between the nip roller 1 and the heat roller 12, an endless drying belt 11 is stretched for circulation. These nip roller 1, the heat roller 12 and the drying belt 11 are pivotable integrally with a pair of swing plates 4 as a drying unit 23.

A pair of swing plates 4 are biased in counterclockwise direction in FIG. 2 by springs 6 disposed between the swing plates and the broom board 21. The drying belt 11 is provided an appropriate tension by means of a joint arm 22.

The drying unit 23 has own driving system. By the driving system, the drying unit 23 can drive the drying belt 11 to circulate in one direction. On a shaft of the nip roller 1, a gear with an one-way clutch is fitted so that when the drying belt 11 is in pressure contact with the photoconductor 14, rotation of the photoconductor will not be transmitted to the driving system of the drying unit 23.

In U-shaped guide grooves 24 formed in respective of pair of swing plate 4, a pair of pushers 10 are slidably engaged. Between these pushers 10, a cleaning roller 7 incorporating a heater, such as halogen lamp or the like, is rotatably supported by a roller shaft 7*a*. The cleaning roller 7 is biased by the pair of pusher 10 to contact with the drying belt 11 under pressure at upper side of the nip roller 1.

On the other hand, on a cam shaft 3 journaled between the side plates 20 on both sides, a pair of eccentric cams 2 are fixed. These eccentric cams 2 are driven by driving the cam shaft 3 with a not shown motor, to rotate to engage with a pair of switch plates 4 to cause pivotal motion of the latter.

Furthermore, on a pair of switch plates 4, crank levers 8 are pivotably supported by pins 9. Each crank lever 8 restricts pivotal motion by engagement between the lower end thereof and the end portion of the cam shaft 3. Also, an upper end portion of each crank lever 8 may engage with a bearing bush (not shown) of the roller shaft 7*a* of the cleaning roller 7 from the lower side. As engaged, the clank lever 8 may lift up the cleaning roller 7 against a force exerted by the pusher 10.

On the other hand, in the wet type image forming apparatus, as shown in FIG. 2, the belt form photoconductor 14 is circulated in a direction shown by an arrow B by rotation of the driving roller 13 in a direction of arrow A (clockwise direction). As guided by the driving roller 13, the toner image is formed on the surface of the photoconductor 14 by a developer (not shown) which performing developing with the liquid developing agent.

In the shown embodiment, materials of the major components of the image drying device are as follows.

The drying belt 11 has to be resistive against sliding contact and heating by the cleaning roller 7 and heat by the heating roller 12 to be durable, and maintain originally required performance of absorbing the developing solvent or the like other than toner from the surface of the photoconductor, and dispersing and evaporating the absorbed developing solvent or the like. In this point of view, as a base material of the drying belt 11, polyethylene terephthalate resin (PET) is preferred, but can be polycarbonate resin (PC), polyimide resin (PI). Then, on the surface of the base material of the resin, a silicon type elastomer material absorbing developing solvent or the like is applied to form an elastomer layer in a thickness of 10 to 100 $\mu$m.

The cleaning roller 7 serves for contacting with the surface of the drying belt 11 under pressure while it is rotating for cleaning and heating by the built-in heater 7*b*. Therefore, as the material of the cleaning roller, silicon rubber is preferred. The nip roller 1 urges drying belt 11 onto the surface of the photoconductor 14 with an appropriate elasticity. Therefore, as a material of the nip roller 1, urethane sponge is preferred. However, ordinary rubber may also be used as the material of the nip roller 1. The heat roller 12 is not required elasticity as that required for the nip roller 1 and is require to have good thermal conductivity for transmitting the heat of the built-in heater 12*a*. Therefore, material having high thermal conductivity may be used.

Next, operation will be discussed.

In the wet type image forming apparatus, the photoconductor 14 is charged. Then, an exposure light is irradiated on the photoconductor 14 per one dot from an exposure light source, such as laser, LED and so forth to form a latent image corresponding to an image information (written). Then, development of the latent image is performed by the developer. In the shown embodiment, with a multi-color developing fluid in liquid state, the latent image on the photoconductor 14 is developed to be visible for overlaying a plurality of color images to form a multi-color toner image. At this time, the image drying device is placed in a condition illustrated in FIG. 2. Namely, a pair of eccentric cams 2 are driven by the motor to be rotated in the direction as shown in FIG. 2. Then, a pair of swing plates 4 are pivoted in counterclockwise direction. Associating with this, the drying unit 23 is moved toward the driving roller 13 to contact the drying belt 11 onto the photoconductor 14 by the nip roller 1 under pressure.

The multi-color visible image formed on the photoconductor 14 is clamped between the roller in the developer and the roller inside of the belt form photoconductor 14 but is maintained in wet condition. In this condition, a ratio of the solid toner component in the developing fluid is about 70%. The liquid component in the developing fluid is consisted of a liquid carrier and other component. In the shown embodiment, the solvent (developing solvent) as primary medium of the developing fluid is a hydrocarbon type solvent.

The driving roller 13 is rotated in the direction of the arrow A to circulate the photoconductor 14 in the direction of the arrow B. Therefore, the nip roller 1 is driven to rotate in the direction of an arrow C to circulate the drying belt 11 in the direction of an arrow D. Associating with this, the cleaning roller 7 is also driven to rotate by the drying belt 11.

The multi-color image or single color image on the photoconductor 14 contains about 70% of solid component and still contains relatively large proportion of liquid component, such as developing solvent, in which the solid toner component and the liquid carrier are dispersed. In order to obtain high quality image on the printing medium, it is inherently required to absorb the developing solvent or the like other than the solid toner component to form thin film state toner image containing 95 to 97% of solid component ratio.

In order to maintain absorption performance, in the shown embodiment, a nip width between the drying belt 11 and the nip roller 1 and the photoconductor 14 is in a range of 5 to 10 nm. On the other hand, temperature control is performed so that the heating roller 12 is preheated in a temperature range of 60 to 90° C. by the built-in heater, and the cleaning roller 7 is pre-heated in a temperature range of 100 to 130° C. before starting printing. The drying belt 11 is heated by both rollers at different points. The heating balance is finally determined by the process speed.

The toner image on the photoconductor 14 transmitted to the position of the driving roller 13 is absorbed the developing solvent other than toner by contacting with the drying belt 11 under pressure during circulation to be formed into a film. Since the drying belt 11 is heated by the heating roller 12, the developing solvent or the like other than toner depositing on the elastomer layer of the drying belt 11 can be instantly dispersed and evaporated by virtue of long peripheral length of the drying belt 11 and large area.

On the other hand, since the cleaning roller 7 is in rotation with contacting with the drying belt 11 under pressure on upper side of the nip roller 1, the surface of the drying belt 11 is cleaned by the cleaning roller 7 under heated condition. Particularly, the cleaning roller 7 is adjusted the temperature to be slightly higher than the temperature of the nip portion of the drying belt 11 by the nip roller 1 to increase adhesion force of the elastomer layer of the drying belt 11 to improve collection ability of the developing solvent or the like other than toner.

Accordingly, in addition to long peripheral length of the drying belt 11, by synergy between heating with the heat roller 12, and cleaning by the cleaning roller 7 with heating, the toner image on the photoconductor transferred to the position of the driving roller 13 is absorbed the developing solvent or the like other than toner with constantly fresh surface of the drying belt 11 to be formed into the film. Therefore, the impurity providing viscosity on the surface of the drying belt 11 is deposited on the surface of the drying belt 11. Therefore, it can avoid to excessively increase adhesion force on the surface of the drying belt 11 to cause picking of the toner image from the photoconductor 14.

However, when the drying belt 11 is contacted with the photoconductor 14 under pressure in the state other than printing state of the wet type image forming apparatus, fatigue of the drying belt 11 and the photoconductor 14 is accelerated, and the photoconductor 14 is stained. Also, if the cleaning roller 7 is contacted with the drying belt under pressure in the state other than printing state of the wet type image forming apparatus, fatigue of the drying belt 11 and cleaning roller is accelerated, and stain is caused on the drying belt 11.

Therefore, in the state other than printing by the wet type image forming apparatus, namely after completion of printing, and initializing state after turning ON of power source of the wet type image forming apparatus, a pair of eccentric cams 2 are driven by the motor in the direction opposite to the direction situating the components in the condition shown in FIG. 2. Then, the eccentric cams 2 engage with a pair of swing plates 4 to pivot the swing plates 4 in clockwise direction. Associating with this, the drying unit 23 is placed at retracted position. Thus the drying belt 11 is moved away from the photoconductor 14. On the other hand, by pivoting a pair of swing plates 4 in clockwise direction, the pin 9 as fulcrum of a pair of crank lever 8 is moved to lift up the cleaning roller 7 by the crank lever 8 against the force of the pusher 10. Namely, the cleaning roller 7 is simultaneously moved to the retracted position away from the drying belt 11. At this time, magnitude of motion of the cleaning roller 7 is smaller than magnitude of motion of the drying unit 23.

During printing state of the wet type image forming apparatus, the drying belt 11 and the cleaning roller 7 are required to be preliminarily heated. Therefore, in the condition where the drying unit 23 and the cleaning roller 7 are placed in the retracted positions as shown in FIG. 3, the heater 12*a* in the heating roller 12 and the heater 7*b* in the cleaning roller 7 are controlled to turn ON and OFF of the power source to be adjusted at predetermined heating temperatures. ON the other hand, the drying unit 23 drives to circulate the drying belt irrespective of the photoconductor 14 by own driving system.

On the other hand, in order to maintain performance, number of printing of the wet type image forming apparatus is counted to heat the cleaning roller 7 by the built-in heater 7*b* as the retracted position for regeneration whenever the counted number of printing reaches a predetermined value. At this time, heating temperature is set to be higher than the temperature upon cleaning (printing) of the drying belt in the condition shown in FIG. 2 in order to improve evaporation efficiency of substance deposited on the cleaning roller.

As set forth above, with the image drying device according to the present invention, the following effect can be achieved.

① By the drying belt circulating in the condition contacting with the surface of the photoconductor after formation of the toner image, the developing solvent or the like other than toner can be absorbed from the surface of the photoconductor. Furthermore, owing to long peripheral length of the drying belt to have large area, area for absorbing, dispersing and evaporating the developing solvent can be certainly provided, and also the drying belt is heated, efficiency of absorbing and the developing solvent or the like other than toner from the surface of the photoconductor after formation of the toner image and driving the absorbed developing solvent or the like can be improved. By this, picking to peel off the toner image from the photoconductor can be avoided to maintain satisfactory image quality for a long period. Also, long life of the components can be achieved.

② By performing cleaning of the drying belt by means of the cleaning roller with heating the former by the built in heater, drying efficiency of the drying belt can be further improved to achieve improvement of the image quality.

③ Other than printing state, by moving the drying unit to place the drying belt away from the photoconductor and by placing the cleaning roller away from the drying belt, fatigue of the photoconductor, the drying belt and the cleaning roller can be reduced and stain thereof can be reduced.

④ When number of printing of the wet type image forming apparatus reaches a predetermined number, the cleaning roller is heated by the built-in heater at the retracted position for regeneration to maintain performance of the cleaning roller.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. An image drying device of a wet type image forming apparatus comprising:

a drying belt circulating in a conduction contacting with a surface of a photoconductor after formation of a toner image and absorbing a developing solvent or the like other than toner from the surface of said photoconductor; and a cleaning roller incorporating a heater and rotating with contacting with said drying belt.

2. An image drying device for a wet type image forming apparatus as set forth in claim 1, which further comprises cleaning roller moving mechanism for moving said cleaning roller between a contacting position where said cleaning roller contact with said drying belt and a retracted position where the cleaning roller is placed away from said drying belt.

3. An image drying device for a wet type image forming apparatus as set forth in claim 2, wherein said cleaning roller moving mechanism places said cleaning roller at said contacting position while said wet type image forming apparatus is in printing operation and at said retracted position otherwise.

4. An image drying device for a wet type image forming apparatus as set forth in claim 3, wherein said cleaning roller is preliminarily heated to a predetermined temperature by means of a heater incorporated therein before moved from said retracted position to said contacting position.

5. An image drying device for a wet type image forming apparatus as set forth in claim 3, wherein said cleaning roller is heated by said heater incorporated therein at said retracted position for regeneration whenever number of printing of said wet type image forming apparatus reaches a preliminarily set number.

6. An image drying device for a wet type image forming apparatus as set forth in claim 1, wherein said drying belt is formed by forming an elastomer layer of a material absorbing a developing solvent or the like on a surface of a base material of polyethylene terephthalate resin.

7. An image drying device for a wet type image forming apparatus comprising:

a nip roller;

a heating roller incorporating a heater therein; and a drying belt wound between said nip roller and said heating roller for circulation, being heated by said heating roller and being urged to contact with a surface of a photoconductor after forming a toner image for absorbing a developing solvent or the like other than toner from said surface of the photoconductor.

8. An image drying device for a wet type image forming apparatus as set forth in claim 7, wherein said nip roller, said heating roller and said drying belt are combined as a drying unit, and said image drying device further comprises a drying unit moving mechanism for moving said drying unit so that said drying belt is displaced between a contacting position where it contacts with said surface of the photoconductor and a retracted position placed away from the surface of photoconductor.

9. An image drying device for a wet type image forming apparatus as set forth in claim 8, wherein said drying unit moving mechanism drives said drying unit to move to said contacting position to contact said drying belt with the surface of said photoconductor while said wet type image forming apparatus is in printing state, and to said retracted position otherwise.

10. An image drying device for a wet type image forming apparatus as set forth in claim 9, wherein said heating roller heated at a predetermined temperature by a heater incorporated therein before being moved from said retracted position to said contacting position.

11. An image drying device for a wet type image forming apparatus as set forth in claim 9, wherein said drying unit may circulate said drying belt by own driving system independently of said photoconductor.

12. An image drying device for a wet type image forming apparatus as set forth in claim 7, wherein said drying belt is formed by forming an elastomer layer of a material absorbing a developing solvent or the like on a surface of a base material of polyethylene terephthalate resin.

13. An image drying device for a wet type image forming apparatus comprising:

a nip roller;

a heating roller incorporating a heater therein;

a drying belt wound between said nip roller and said heating roller for circulation, being heated by said heating roller and being urged to contact with a surface of a photoconductor after forming a toner image for absorbing a developing solvent or the like other than toner from said surface of the photoconductor; and a cleaning roller incorporating a heater and rotating with contacting with said drying belt.

14. An image drying device for a wet type image forming apparatus as set forth in claim 13, wherein said nip roller, said heating roller and said drying belt are combined as a drying unit, and said image drying device further comprises a drying unit moving mechanism for moving said drying unit so that said drying belt is displaced between a contacting position where it contacts with said surface of the photoconductor and a retracted position placed away from the surface of photoconductor.

15. An image drying device f or a wet type image forming apparatus as set forth in claim 14, wherein said drying unit moving mechanism drives said drying unit to move to said contacting position to contact said drying belt with the surf ace of said photoconductor while said wet type image forming apparatus is in printing state, and to said retracted position otherwise.

16. An image drying device for a wet type image forming apparatus as set forth in claim 15, wherein said heating roller heated at a predetermined temperature by a heater incorporated therein before being moved from said retracted position to said contacting position.

17. An image drying device for a wet type image forming apparatus as set forth in claim 15, wherein said drying unit may circulate said drying belt by own driving system independently of said photoconductor.

18. An image drying device for a wet type image forming apparatus as set forth in claim 17, wherein said drying belt is formed by forming an elastomer layer of a material absorbing a developing solvent or the like on a surface of a base material of polyethylene terephthalate resin.

19. An image drying device for a wet type image forming apparatus as set forth in claim 18, further comprising a cleaning roller moving mechanism, wherein said cleaning roller moving mechanism places said cleaning roller at said contacting position while said wet type image forming apparatus is in printing operation and at said retracted position otherwise.

20. An image drying device for a wet type image forming apparatus as set forth in claim 19, wherein said cleaning roller is preliminarily heated to a predetermined temperature by means of a heater incorporated therein before moved from said retracted position to said contacting position.

21. An image drying device for a wet type image forming apparatus as set forth in claim 19, wherein said cleaning roller is heated by said heater incorporated therein at said retracted position for regeneration whenever number of printing of said wet type image forming apparatus reaches a preliminarily set number.

22. An image drying device for a wet type image forming apparatus as set forth in claim 13, wherein said drying belt is formed by forming an elastomer layer of a material absorbing a developing solvent or the like on a surface of a base material of polyethylene terephthalate resin.

* * * * *